United States Patent [19]

Kishel

[11] 4,169,999

[45] Oct. 2, 1979

[54] THERMAL-MAGNETIC SWITCH

[75] Inventor: Joseph F. Kishel, Clarks Summit, Pa.

[73] Assignee: Sangamo Weston, Inc., Norcross, Ga.

[21] Appl. No.: 847,513

[22] Filed: Nov. 1, 1977

[51] Int. Cl.[2] ..... H01H 37/02

[52] U.S. Cl. ..... 337/2; 337/145

[58] Field of Search ..... 337/2, 114, 115, 118, 337/119, 120, 142, 143, 145, 148, 228, 401, 403, 405, 407, 417; 335/51

[56] References Cited

U.S. PATENT DOCUMENTS

| | | | |
|---|---|---|---|
| 2,599,441 | 6/1952 | Ekman | 337/403 |
| 3,043,937 | 7/1962 | Milton et al. | 337/405 |
| 3,462,573 | 8/1969 | Rabinowitz et al. | 337/51 |
| 3,660,794 | 5/1972 | Brizzolara | 337/401 |
| 3,947,798 | 3/1976 | Zankl | 337/228 |
| 3,964,010 | 6/1976 | Tasuku | 337/148 |

*Primary Examiner*—George Harris
*Attorney, Agent, or Firm*—Edward D. Manzo

[57] ABSTRACT

A remotely actuable switch includes a housing defining a cavity having first and second thermally separated chambers, each enclosing a pair of spaced electrical contacts and each having an associated heating element. An electrically conductive fusible element occupies one of the chambers and electrically bridges the spaced contacts therein. To activate the switch the first heating element is activated to melt the fusible element, allowing a Lorentz force resulting from an applied external magnetic field and from current passing between the bridged contacts to expel the melted fusible material from the first chamber into the second chamber. A helical passage may be used as an alternative to a cavity with discrete chambers.

12 Claims, 4 Drawing Figures

THERMAL-MAGNETIC SWITCH

BACKGROUND OF THE INVENTION

The present invention relates to remote electrical switches and particularly to those using a fusible material or a eutectic to bridge a gap between a pair of spaced electrical contacts. Also, the present invention relates to a switch having magnetic means for moving an element bridging such contacts.

The use of a fusible element or eutectic in such switches devices as fues is well known to the art. For example, Zankl, U.S. Pat. No. 3,947,798 shows a fusible element forming part of an electrical path. After the fusible element melts, it is moved by the force of gavity, thereby opening the electrical path. Other switches or fuses employ a fusible element in combination with mechanical urging means to bias a separate element held in position by the fusible material. See, for example U.S. Pat. Nos. 3,964,010, 3,043,937 and 2,599,411.

Still other types of switches or fuses known to the art include magnetic means which use a Lorentz force to move a liqiud element through which current is passing. For example, Rabinowitz et al, U.S. Pat. No. 3,462,573 shows a circuit interrupter using liquid gallium disposed in a container having opposing ends, one of such ends being positioned within the field of an electromagnet. Means are provided to pass current through the liquid, and when a magnetic field is applied, the Lorentz force moves the liquid out of the field, thereby opening the electrical path.

Several disadvantages inhere in the prior art switches or fuses. Those using a eutectic or fusible material are generally not reusable. Others such as Zankl are reusable but must be manually reset. Accordingly, while they may be remotely positioned, they must be accessable to a manual operator for resetting purposes.

Switches such as Rabinowitz using liqiud elements such as liquid gallium or mercury are position sensitive and interpose a significant resistance with the switch is in closed position. Hence, such a switch is disadvantagious where residual contact resistance is a major factor, such as in remote selection of one of a plurality of resistances or voltages to be applied to an electrical circuit.

Accordingly, it is the principal object of the present invention to provide a switch which has an extremely low closed resistance.

It is a further object of the present invention to provide a reusable switch which may be operated from a remote position.

SUMMARY OF THE INVENTION

These and other objects are achieved by providing a pair of spaced contacts in a region or chamber of a cavity having at least two chambers or regions. An electrically conductive fusible element, preferably a eutectic, is fused to each of the spaced contacts, thereby electrically bridging them. The region of chamber has associated heating means for heating the fusible element. The region containing the eutectic is positioned within a magnetic field. To activate the switch, the eutectic is melted by an appropriate heating element or by passing a current between the contacts which is itself sufficient to liquify the eutectic. The eutectic is magnetically expelled through the action of a Lorentz force into the opposing region or chamber, where it solidifies. In preferred embodiments, the second region or cavity includes a second pair of spaced contacts, heating means, and a magnetic field, so that the eutectic expelled from the first region will bridge electrically the second pair of spaced contacts.

BRIEF DESCRIPTION OF THE DRAWINGS

Other objects, features and advantages of the present invention will be apparent from the following description which refers to the accompanying drawing, wherein like reference numerals denote corresponding parts in the several views.

DESCRIPTION OF A PREFERRED EMBODIMENT

Figure 1:
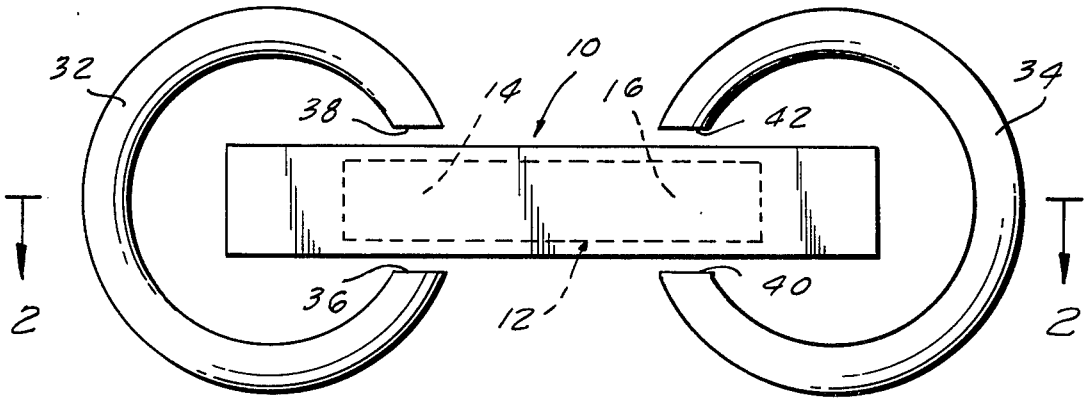
FIG. 1 is an illustrative plan view of a switch according to the present invention.

Referring to the drawings, a switch made according to the present invention includes a housing 10 made or formed preferably of a non-conductive material, although a conductive material could be used as later described. Housing 10 includes a cavity 12 which has two opposed thermally separate chambers 14 and 16 of approximately equal volume, joined by a chamber duct 18 having a diameter smaller than the largest diameter of either of the chambers 14 and 16.

Each chamber 14 and 16 includes a pair of spaced contacts 20*a*, 20*b* and 22d*a*, 22*b*, respectively. Where housing 10 is composed of a non-conductor, spaced contacts 20 and 22 are electrically separate (but for a fusible element described below). If a conductive material is used, however, each contact must be electrically insulated from the other of the pair. As shown illustratively in the figures, each pair of the spaced contacts is oriented generally horizontally, but it will be understood that the contacts may be oriented in other manners, for instance, vertically, on opposing walls of the corresponding cavity. Moreover, if desired, either or both of the chambers 14 and 16 may include a plurality of spaced contacts should electrical connection be desired among more than two lines. The interior ends of each contact in each chamber are slightly spaced from one another to be electrically closed from time to time in the manner and for the purposes hereinafter more particularly described. Each of the contacts is electrically connected to a corresponding lead passing through the wall of the appropriate chamber and through the housing 10, to communicate electrically with the switch contacts. As can be seen clearly from FIG. 2, electrical leads A, B, C and D are attached to contacts 20*a*, 20*b*, 22*a* and 22*b*, respectively.

A fusible element 24 is shown illustratively positioned in chamber 14. The fusible element 24 is preferably a eutectic material, that is, one which displays a sudden transition to a liquid phase when it reaches it melting point. Fusible element 24 is in a solid phase at the switches's operating temperature, and several of the bismuth alloys, which display melting points of from 117° up through 520° can be used, depending on the projected operating temperature and desired characteristics of the switch.

A sufficient quantity of fusible element 24 is used so that when positioned in one of the chambers 14 and 16 the fusible element 24 electrically connects the corresponding pair of spaced contacts 20 or 22, respectively. The fusible element 24 should not be so great, however, as to occupy fully one of the chambers and part of the other chamber.

Figure 2:
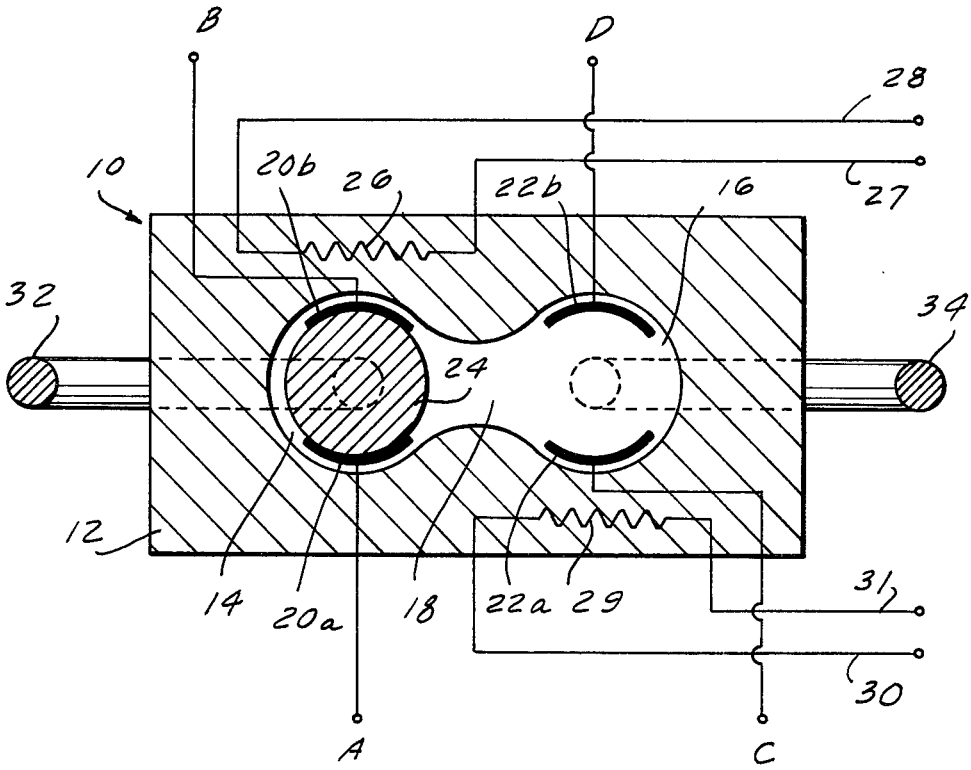
FIG. 2 is an illustrative sectional view of the switch shown in FIG. 1, illustrating details of the internal circuitry.

A heating element 26, shown schematically in FIG. 2, is positioned within housing 10 and outside but proximate chamber 14. Heating element 26 is connected to leads 27 and 28 for communicating electrically with the outside of the switch. Heating element 26 is adapted to carry a current applied through leads 27 and 28 thereby to heat chamber 14 to a temperature exceeding the solid-to-liquid transistion temperature of fusible element 24. As will be explained more fully below, heating element 26 may be omitted if switching action is desired whenever a predetermined current flows between either pair of spaced contacts 20 or 22. A similar heating element 29 is positioned proximate chamber 14, and is associated with leads 30 and 31.

As can be seen from FIG. 1, the chambers 14 and 16 are positioned within resepective magnetic fields set up by permanent horseshoe magents 32 and 34 having their respective pole pieces 36, 38 and 40, 42 on opposing sides of the chambers 14 and 16, respectively. Other orientations may be used, so long as the magnetic field has a component which is perpendicular to the direction of current flow, described more fully below, between the contacts. It will be understood that although two separate permanent magnets are illustrated, a single permanent magnet could be used to set up a magentic field through both chambers of cavity 12. Alternatively, a single permanent magnet could be used to set up a field in only one chamber, provided that mechanical means were utilized to move the housing 10 so that the appropriate chamber 14 or 16 would be positioned within the magnetic field. It will also be understood that one or more electromagnets could be used rather than permanent magnets. The magnetic field strength at each chamber, whether set up by a permanent magnet or electromagnet, should be in the range of approximately 5,000 to 10,000 gauss.

The switch illustrated in FIGS. 1 and 2 operates as follows. When the fusible element 24 is disposed within chamber 14, as shown illustratively in FIG. 2, a current i, (applied externally) can pass from lead A, to contact 20*a*, through fusible element 24, to contact 20*b*, and to lead B or vice versa. Fusible element 24 at normal operating temperature prior to switching is in a solid phase and therefore interposes an extremely small resistance between spaced contacts 20*a* and 20*b*. No current can flow from lead C to lead D since the contacts 22*a* and 22*b* are spaced apart and not bridged by an electrically conductive material.

When a current does flow between a pair of contacts, by virtue of the electric charges moving through a magnetic field, a force is exerted on the fusible element 24 through which the charge pass. The force is stated by the Lorentz relation as follows:

$$\vec{F}=g_o\vec{E}+q_o\vec{V}=\vec{B}$$

where $q_o$ is the charge, E is the electric field vector, V is the velocity of a moving positive charge, and B is the magnetic induction vector (in gauss). In the environment of the switch th external electric field vector is zero, preferably, so that the Lorentz relation and its corollary are stated as follows:

$$\vec{F}=q_o\vec{V}\times\vec{B}=i\vec{l}\times\vec{B}$$

where i is the current passing from lead A to lead B and $\vec{1}$ is a displacement vector which points along the direction of the current. Preferably the magnetic field is positioned at right angles to the direction of current flow and accordingly, the force applied to the fusible element 24 is stated:

$$F=(Bil/10)$$

where F is in dynes, i is the current in amperes, 1 is the distance through which the current flows (in centimeters), and B is the magnetic induction (in gauss) between contacts 20*a* and 20*b*.

As mentioned, supra, prior to switching fusible element 24 is in the solid phase. Accordingly, the Lorentz force exerted thereon does not result in a displacement. When switching is desired, heating element 26 is activated by applying an electric current through 27 and 28. Heating element 26 causes its environs to heat and concomitantly raises the temperature of fusible element 24, eventually causing it to enter the liquid phase. As a eutectic, fusible element 24 displays a fairly rapid transition from liquid phase to solid phase once the melting temperature is reached.

Current continues to flow from line A to line B while heating element 26 is activated. Accordingly, once fusible element 24 liquifies, the Lorentz force acts upon it until it is displaced enough to remove the bridge between contacts 20, so that current no longer flows from line A to line B. However, the force applied to fusible element 24 imparts sufficient inertia so that the now liquidified fusible element 24 passes through duct 18 and into the cooler chamber 16 where it bridges the gap between spaced contacts 22*a* and 22*b*. Fusible element 24 then enters the solid phase and is constrained within chamber 16 until it again enters the liquid phase by operation of heating element 29.

Another embodiment of the present invention (not shown in the figures) omits heating elements 26 and 29 and is designed to switch the connection from A–B to C–D when the current passing from A to B is sufficient to heat fusible element 24 to the solid-to-liquid phase transition temperature. With such a design, the switch operates automatically.

Figure 4:
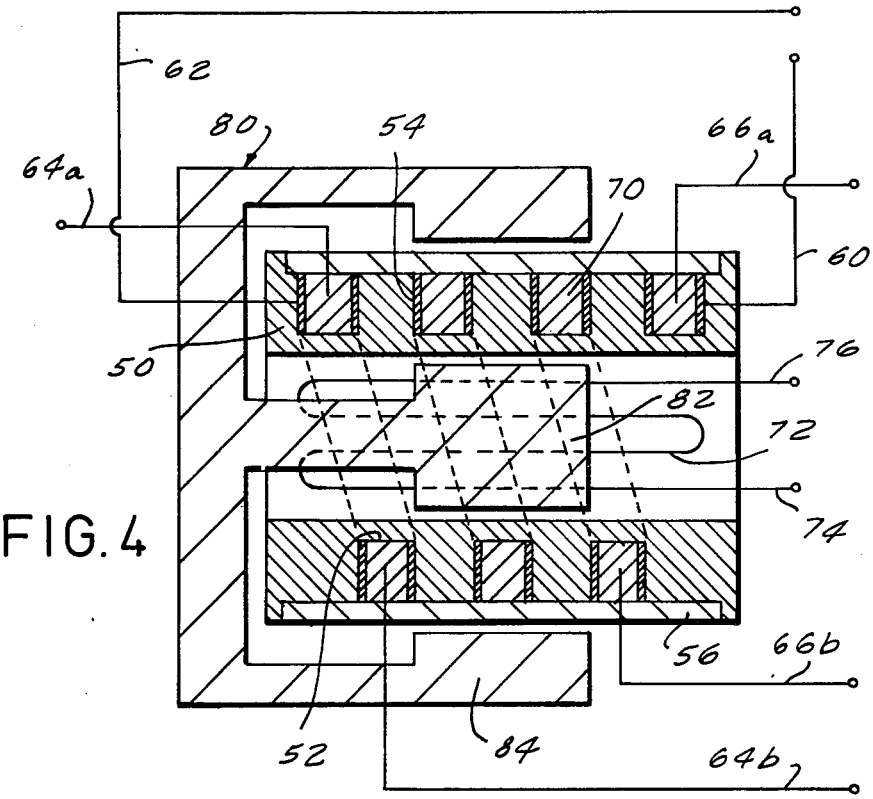
FIG. 4 is a sectional veiw of the switch shown in FIG. 3 illustrating details of the internal circuitry thereof.
Figure 3:
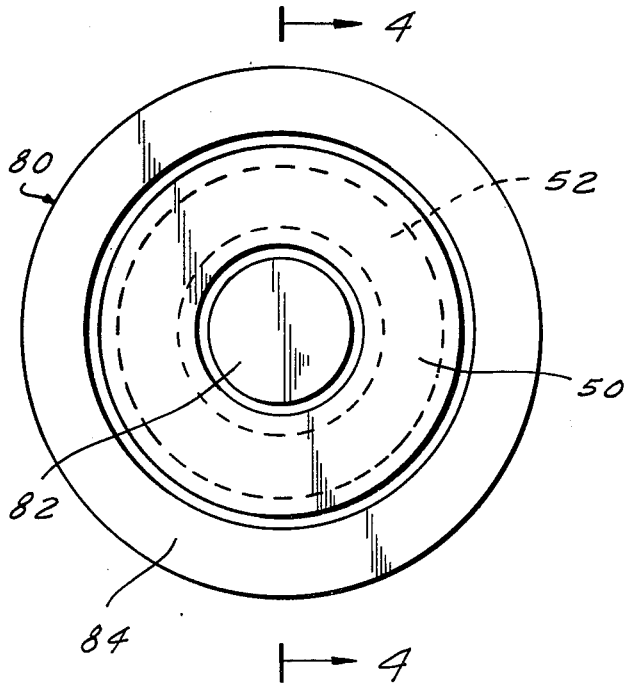
FIG. 3 is a front view of a second embodiment of a switch according to the present invention.

A further embodiment illustrated in FIGS. 3 and 4 includes a continuous passage containing a fusible material and means for applying a current to a fusible element separate from any current flowing between the contacts used for switching. Specifically, this embodiment includes a cylinder 50 composed of a non-conductive material. Cylinder 50 has a helical groove or channel 52 formed or machined on its outer surface. Both of the walls along the helix, but not the base, are plated with a conductive metal 54 along the length of the groove 52. A cover 56 made of a non-conductive material annularly surrounds cylinder 50 and intimately contacts the exterior surface thereof so that a fluid moving through groove 52 may not depart therefrom.

A wire conductor 60 is connected electrically to the metal plating on one of the channel walls. A second wire conductor 62 is connected to the metal plating 54 on the opposite channel wall of helical groove 52. Accordingly, for any given point along helical groove 52, a voltage may be applied separately to the electrical coating on opposing channel walls.

Positioned within groove 52 are a pair of contacts *64a, 64b* at one end of groove 52, and a second pair *66a, 66b* at the other end. A eutectic material 70 is shown illustratively in FIG. 4 occupying two turns of helical groove 52 at the left side thereof. Eutectic 70 electrically connects contacts *64a* and *64b*, does not extent into the portion of helical groove 52 to connect contacts *66a 66b*.

An annular heating element 72 is positioned radially inward of the tubular cylinder 50 and extending along the length of the helical groove 52. Heating element 72 intimately contacts the inside wall of tube 50 and may receive a current from conductors 74 and 76 communicating with heating element 72.

An annular magnet 80 has a radial magnetic field substantially passing from its central pole piece 82 to its peripheral pole piece 84 which surrounds annularly the center pole 82. The magnet 80, tube 50 and heater 72 are so dimensioned that the tube 50 and heating element 72 combination will fit over center pole piece 82 and within the inside diameter of peripheral pole 84. Accordingly, a magnetic field extends radially through the cylinder 50.

To operate this switch, a current is applied to heating element 72 through conductor 74 and 76. The heating element 72 raises the temperature of the eutectic 70 to its melting point. A second "drive" current is applied to conductor 60 and 62 of an appropriate polarity. Such drive current causes electric charge to move from metal plating 54 on one of the channel walls of groove 52, through eutectic 70, to the metal plating 54 on the opposite wall of groove 52. Since the electric charge moves through the magnetic field of magnet 80 in a direction perpendicular to magnetic vector B, a Lorentz force is applied to the eutectic 70 and moves it along groove 52, causing it to open the connection between contacts *64a, 64b* and to bridge contacts *66a, 66b*.

To return eutectic 70 to its initial position, the heating element 72 is activated and a drive current of polarity opposite the first-named polarity is applied to conductor 60 and 62. This causes the Lorentz force to reverse its direction by 180°, thereby causing the eutectic 70 to move in an opposite direction.

It is evident that the switch according to the present invention achieves the aforementioned objectives and displays substantial advantages over currently known switches. As a result of fusing spaced contacts with an electrically conductive material in its solid rather than liquid phase, the resulting switch is not position sensitive. Additionally, the fusible element in a solid phase offers a very low contact resistance when compared to fusible elements or mercury in a liquid phase. Hence, a switch according to the present invention is particularly useful in cases where residual contact resistance is a factor. Moreover, such a switch is extremely reliable, being based on a fused element rather than a friction contact.

From the foregoing description, it will be apparent to those skilled in the art that the present invention is capable dof taking a variety of useful forms, and it is preferred, therefore, that this description be taken in an illustrative sense, and that the scope of protection afforded be determined by the appended claims.

What is claimed is:

1. A switch comprising:

a housing defining a cavity having first and second regions communicating with one another;

a pair of spaced contacts positioned in said first region;

means for communicating electrically with said contacts;

an electrically conductive fusible element disposed within said cavity and bridging said contacts when said fusible element is disposed within said first region, said fusible element being in a solid phase at normal operating temperatures of said switch;

means for melting said fusible element; and magnet means for setting up a magnetic field in said first region, said field having a component to generate a Lorentz force, when current flows in said fusible element disposed in said first region, urging said fusible element toward said second region.

2. A switch according to claim 1 further comprising:

a second pair of spaced contacts positioned in said second region;

means for communicating electrically with said second pair of spaced contacts;

said melting means including means for melting said fusible element when positioned in said first region and means for melting said fusible element when positioned in said second region;

said magnet means including means for setting up a magnetic field in said region, said field having a component to generate a Lorentz force, when current flows in said fusible element disposed in said second region, urging said fusible element toward said first region.

3. A switch according to claim 1 wherein said heating means includes a heating element within said housing and proximate said region and means for activating said heating element.

4. A switch according to claim 1 wherein said magnet means includes a magnet adapted to set up a magnetic field throughout one of said regions, and further comprising mechanical means for moving said housing to position a selected one of said regions within said magnetic field.

5. A switch according to claim 1 wherein said fusible element is a eutectic material having its melting point between approximately 117° Fahrenheit and approximately 520° Fahrenheit.

6. A switch comprising:

a housing defining a continuous passage;

at least three electrical contacts in spaced relationship and disposed within said passage;

means for communicating electrically with said contacts;

a fusible element disposed within said passage and electrically bridging at least two but not all of said contacts;

means for heating said fusible element to its solid phase-to-liquid phase transition temperature;

magnet means for setting up a magnetic field through at least a portion of said passage, said field having a component to generate a Lorentz force urging said fusible element along said passage, when a electrical current flows in said fusible element.

7. A switch according to claim 6 wherein said passage is helical.

8. A switch according to claim 7 wherein said magnetic means sets up a magnetic field radially with respect to said helix.

9. A switch according to claim 6 further comprising means for applying a current to flow across said fusible element.

10. A switch according to claim 9 wherein said applying means includes first and second electrically conductive platings, said first plating disposed on one wall of said passage and said second plating disposed on an opposing wall of said passage, and means communicating electrically with said platings.

11. A switch comprising;

a housing defining a cavity having first and second chambers communicating with one another;

a pair of spaced contacts positioned in said first chamber;

means for communication electrically with said contacts;

an electrically conductive fusible element disposed in said cavity and bridging said contacts when said fusible element is disposed in said first chamber, said fusible element being in a solid phase at normal operating temperatures of said switch;

magnet means for setting up a magnetic field in said first chamber to generate a Lorentz force, when current flows between said contacts, urging said fusible element toward said second chamber;

said fusible element adapted to enter a liquid phase in response to a predetermined current passing between said contacts.

12. A switch comprising:

a housing containing a void;

a pair of electrical contacts positioned in said void;

a fusible element positioned in said void and in its solid phase at switch operating temperatures;

a magnet for applying a Lorentz force to said fusible element when current flows through said fusible element, said magnet being oriented to urge said element away from said contacts; and means for melting said fusible element.

* * * * *

UNITED STATES PATENT AND TRADEMARK OFFICE

CERTIFICATE OF CORRECTION

PATENT NO. : 4,169,999

DATED : October 2, 1979

INVENTOR(S) : Joseph F. Kishel

It is certified that error appears in the above-identified patent and that said Letters Patent are hereby corrected as shown below:

Column 1, line 12, "switches" should read — switch —.

Column 1, line 12, "fues" should read -- fuses —.

Column 1, line 20, "2,599,411" should read — 2,599,441 —.

Column 1, line 23, "liqiud" should read — liquid —.

Column 1, line 36, "accessable" should read — accessible —.

Column 1, line 38, "liqiud" should read — liquid —.

Column 1, line 41, "disadvantagious" should read — disadvantageous —.

Column 1, line 59, "of" should read -- or —.

Column 2, line 9, "drawing" should read — drawings —.

Column 2, line 20, "veiw" should read -- view —.

Column 2, line 36, "22da" should read — 22a —.

Column 2, line 64, "it", second occurrence, should read -- its —.

Column 2, line 66, "switches's" should read — switch's —.

UNITED STATES PATENT AND TRADEMARK OFFICE

CERTIFICATE OF CORRECTION

PATENT NO. : 4,169,999

DATED : October 2, 1979

INVENTOR(S) : Joseph F. Kishel

It is certified that error appears in the above-identified patent and that said Letters Patent are hereby corrected as shown below:

Column 3, line 17, "transistion" should read — transition —.

Column 3, line 26, "magents" should read — magnets —.

Column 3, line 34, "magentic" should read — magnetic —.

Column 3, line 61, "charge" should read — charges —.

Column 3, line 64, "$F = g_oE + q_oV = B$" should read — $F = q_oE + q_oV \times B$ —.

Column 3, line 69, "th" should read — the —.

Column 4, line 1, delete the character after "zero" and before "preferably" and insert a comma therefor.

Column 4, line 36, "liquidified" should read — liquified —.

Column 5, line 8, insert — but — before "does".

Column 5, line 8, "extent" should read — extend —.

Column 5, line 10, insert — and — between "66a" and "66b".

Column 5, line 62, "dof" should read — of —.

UNITED STATES PATENT AND TRADEMARK OFFICE

CERTIFICATE OF CORRECTION

PATENT NO. : 4,169,999

DATED : October 2, 1979

INVENTOR(S) : Joseph F. Kishel

It is certified that error appears in the above-identified patent and that said Letters Patent are hereby corrected as shown below:

Claim 2, column 6, line 28, insert — second — between "said" and "region".

Claim 11, column 7, line 16, "communication" should read — communicating —.

Signed and Sealed this

Seventh Day of September 1982

[SEAL]

Attest:

GERALD J. MOSSINGHOFF

Attesting Officer

Commissioner of Patents and Trademarks